United States Patent [19]

Tanaka

[11] Patent Number: 4,852,417

[45] Date of Patent: Aug. 1, 1989

[54] STARTER FOR ENGINE

[75] Inventor: Toshinori Tanaka, Hyogo, Japan

[73] Assignee: Mitsubishi Denki Kabushiki Kaisha, Tokyo, Japan

[21] Appl. No.: 168,267

[22] Filed: Mar. 15, 1988

[30] Foreign Application Priority Data

Mar. 18, 1987 [JP] Japan ..... 62-40548[U]

[51] Int. Cl.[4] ..... F02N 15/06

[52] U.S. Cl. ..... 74/7 E; 74/7 A; 74/7 C; 74/801; 310/83; 335/131

[58] Field of Search ..... 74/7 A, 7 C, 7 E, 7 R, 74/801; 310/83; 335/131

[56] References Cited

U.S. PATENT DOCUMENTS

| | | | |
|---|---|---|---|
| 4,327,300 | 4/1982 | Hoven | 74/7 C |
| 4,488,054 | 12/1984 | Ebihara | 74/7 A |
| 4,553,441 | 11/1985 | Hamano et al. | 74/7 R |
| 4,587,861 | 5/1986 | Morishita | 74/7 A |
| 4,592,243 | 6/1986 | Katoh et al. | 74/7 E |
| 4,760,274 | 7/1988 | Isozumi | 74/7 A |

FOREIGN PATENT DOCUMENTS

| | | |
|---|---|---|
| 115823 | 9/1974 | Japan . |
| JP87/00729 | 10/1987 | PCT Int'l Appl. . |

*Primary Examiner*—Allan D. Herrmann

*Attorney, Agent, or Firm*—Wolf, Greenfield & Sacks

[57] ABSTRACT

A coaxial type starter used to start an engine of a vehicle is disclosed. The starter includes a d.c. motor having a hollow armature rotary shaft incorporating an overrunning clutch, an epicyclic reduction gear having a carrier for supporting a plurality of planet gears which revolve while in engagement with a sun gear formed on a tubular clutch inner member received and supported inside the armature rotary shaft, and an output rotary shaft extending through a tubular member which is formed integral with the carrier, the tubular member being in spline-engagement with the output rotary shaft. Thus, it is possible to reduce the overall length of the starter by a large margin.

25 Claims, 3 Drawing Sheets

STARTER FOR ENGINE

BACKGROUND OF THE INVENTION

1. Field of the Invention

The present invention relates to a starter for an engine and, more particularly, to a coaxial type starter used to start an engine of a vehicle.

2. Description of the Prior Art

A conventional starter used to start an engine of a vehicle has heretofore been arranged as shown in FIG. 3.

The conventional starter 1 shown in FIG. 3 comprises a d.c. motor 2, an overrunning clutch 4 slidably fitted on an output rotary shaft 3, a reduction gear 5 arranged to transmit the rotational force derived from an armature rotary shaft 2*a* of the d.c. motor 2 to a clutch outer member 4*a* of the overrunning clutch 4 after reducing the speed thereof, and a shift lever 8 having one end thereof engaged with a plunger rod of an electromagnetic switch 6 disposed at one side of the d.c. motor 2 and the other end thereof engaged with an annular member 7 secured to the overrunning clutch 4 in order to cause the overrunning clutch 4 to slide on the output rotary shaft 3.

Thus, the conventional starter 1 needs the shift lever 8 in order to cause the overrunning clutch 4 to slide on the output rotary shaft 3, and the electromagnetic switch 6 which actuates the shift lever 8 and also turns on the power supply for the d.c. motor 2 is disposed at the side of the d.c. motor 2, that is, the starter 1 has the so-called biaxial arrangement. Therefore, the types of engine layout that have been feasible when designing a vehicle have heretofore been restricted to a substantial extent.

In order to avoid the above-described problem, it has been proposed to dispose the electromagnetic switch at one axial end of the d.c. motor so that the starter may have a simple configuration such as a relatively long and narrow tubular shape. According to this proposition, the starter is basically arranged such that the armature rotary shaft of the d.c. motor is made hollow and a rod, for example, a plunger rod, of the electromagnetic switch which has heretofore been used to actuate the shift lever is passed through the passage formed inside the armature rotary shaft so as to extend as far as the output rotary shaft. Since the armature rotary shaft of the d.c. motor and the rod of the electromagnetic switch are disposed on the same axis, this starter is known as the coaxial type starter.

The above-described coaxial type starter has a simplified overall configuration, that is, a relatively long and narrow tubular shape, but it suffers from the problem that, since the electromagnetic switch is disposed at the rear end of the d.c. motor, the overall length of the starter is increased by a large margin.

SUMMARY OF THE INVENTION

In view of the above-described problems of the prior art, it is a primary object of the present invention to provide a starter for an engine which has an overrunning clutch incorporated inside an armature rotary shaft of a d.c. motor in order to reduce the overall length and which is also provided with an epicyclic reduction gear.

To this end, the present invention provides a starter for an engine which comprises a d.c. motor having a hollow armature rotary shaft incorporating an overrunning clutch, an epicyclic reduction gear having a carrier for supporting a plurality of planet gears which revolve while being in engagement with a sun gear formed on a tubular clutch inner member received and supported inside the armature rotary shaft, and an output rotary shaft extending through a tubular member which is formed integral with the carrier, the tubular member being in spline-engagement with the output rotary shaft.

According to the present invention, when the electromagnetic switch of the engine starter is energized, the output rotary shaft is pushed out by the rod of the switch while compressing a return coil spring and, at the same time, the power supply of the motor is turned on. As a result, the rotational force derived from the armature rotary shaft of the motor is transmitted to the clutch inner member through the overrunning clutch. The rotation of the clutch inner member is transmitted to the carrier and the tubular member after the speed thereof has been reduced through the epicyclic reduction gear, and the rotation of the tubular member is transmitted to the output rotary shaft to start the engine. After the engine has been started, the electromagnetic switch is de-energized, and the reverse rotation transmitted from the engine is cut off by the overrunning clutch, thus preventing the armature rotary shaft of the motor from being caused to rotate at high speed by the reverse transmission of the rotational force.

BRIEF DESCRIPTION OF THE DRAWINGS

The above and other objects, features and advantages of the present invention will become more apparent from the following description of the preferred embodiment thereof, taken in conjunction with the accompanying drawings, in which like reference numerals denote like elements, and in which.

DESCRIPTION OF THE PREFERRED EMBODIMENT:

The starter for an engine according to the present invention will be described hereinunder in detail by way of one preferred embodiment and with reference to the accompanying drawings.

Figure 1:
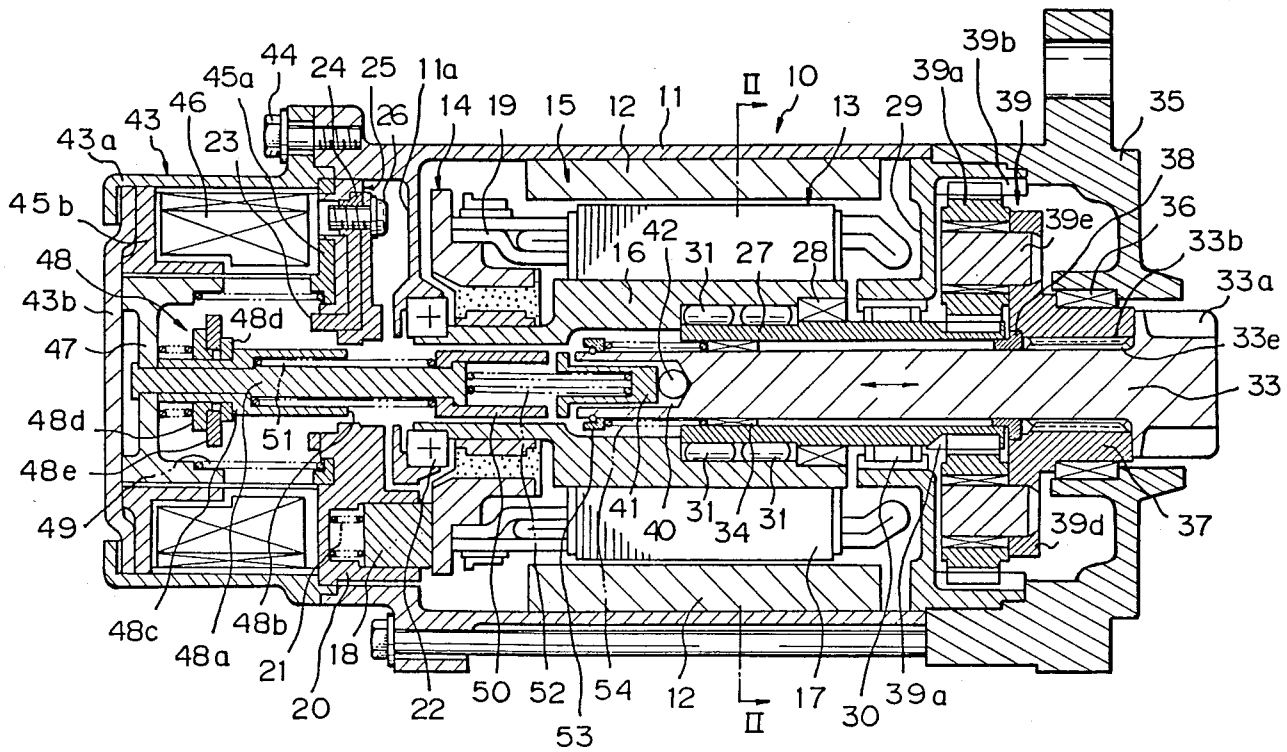
FIG. 1 is a sectional view of one embodiment of the starter for an engine according to the present invention.
Figure 2:
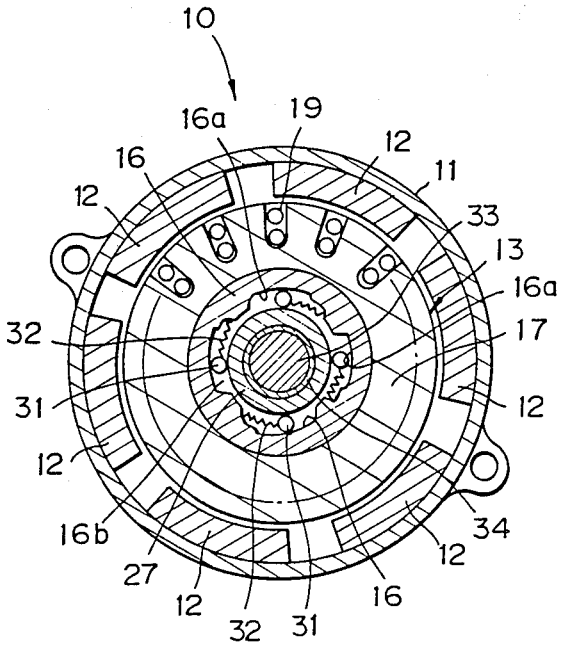
FIG. 2 is a sectional view taken along the line II—II of FIG. 1.
Figure 3:
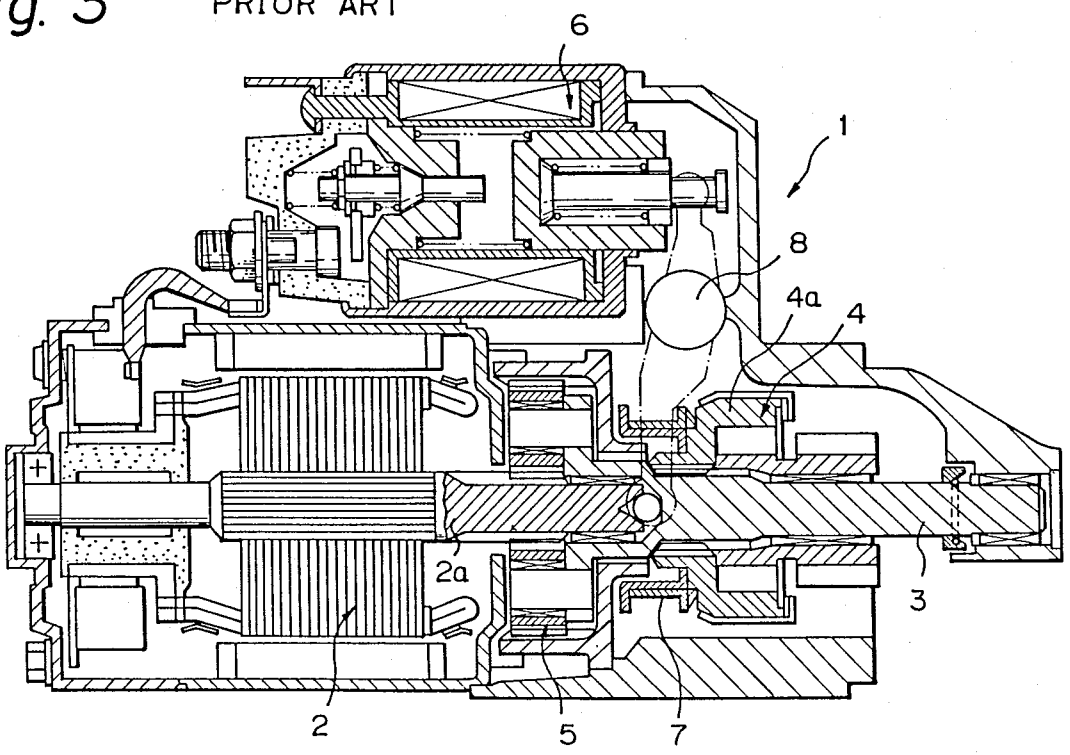
Fig. 3 PRIOR ART
FIG. 3 is a sectional view of a conventional starter for an engine.

FIGS. 1 and 2 show in combination a starter 10 for an engine according to one embodiment of the present invention.

The engine starter 10 of this embodiment includes a d.c. motor 15 consisting mainly of permanent magnets 12 which are rigidly disposed at spacings in the circumferential direction on the inner peripheral surface of a yoke 11 which forms a magnetic circuit and which also defines an outer wall of the starter 10, an armature 13 rotatably disposed in the center of the yoke 11, and a face type commutator 14 provided at one axial end of the armature 13.

The armature 13 of this d.c. motor 15 is composed of a hollow armature rotary shaft 16 and an armature core 17 mounted on the outer periphery of the armature rotary shaft 16. An enlarged-diameter portion, that is, a recess, is formed in the inner peripheral portion of the hollow armature rotary shaft 16. A plurality of circumferentially spaced cam surfaces 16*a* (see FIG. 2) are formed in the peripheral surface of the recess. The face type commutator 14 is fitted on the outer periphery of one end portion, that is, the left-end portion as viewed in FIG. 1, of the armature rotary shaft 16. The commutator 14 consists of a multiplicity of segments which are disposed on a surface thereof which is at right angles to the axis of the armature rotary shaft 16 so that the segments are in sliding contact with a plurality of brushes 18 to effect commutation. Each segment is connected with one end of an armature coil 19 which is wound on the armature core 17.

The brushes 18 are supported by a brush holder 20 made of a plastic material which is disposed on the outside of a rear bracket portion 11*a*. The rear bracket portion 11*a* is formed integral with the yoke 11 to constitute a grounded circuit. Each brush 18 is pressed against the slide surface of the commutator 14 by a spring 21 through an opening formed in the rear bracket portion 11*a*. A bearing 22 is fitted to the inner peripheral surface of the central opening in the rear bracket portion 11*a* to support the rear end portion of the armature rotary shaft 16, that is, that end portion thereof which is closer to the commutator 14. The brush holder 20 is composed of a fixed contact 23 which is connected to a terminal (not shown), the fixed contact 23 being formed integral with the rear end portion of the brush holder 20 by insert molding process, and a terminal 25 rigidly secured to the fixed contact 23 by a screw 26, the terminal 25 having a plus-side lead wire 24 for the brushes 18 welded thereto.

The cam surfaces 16*a* that are formed on the circumferential surface of the recess inside the armature rotary shaft 16 constitute one element of an overrunning clutch mechanism. More specifically, a tubular clutch inner member 27 is received in the hollow portion of the armature rotary shaft 16 in such a manner that the clutch inner member 27 extends over the cam surfaces 16*a*, and the clutch inner member 27 is rotatably supported through a bearing 28 which is disposed at the forward end (the right-hand end as viewed in FIG. 1) of the armature rotary shaft 16. The clutch inner member 27 has an extended portion which projects forwardly from the distal end of the armature rotary shaft 16. The extended portion is rotatably supported by a bearing 30 fitted to a boss-shaped portion of a center bracket 29 which is secured to the forward end of the yoke 11. Thus, a plurality of wedge-shaped spaces 16*b* are defined between the outer peripheral surface of the clutch inner member 27 and the cam surfaces 16*a* formed on the inner peripheral surface of the recess inside the armature rotary shaft 16, as clearly shown in FIG. 2. In each wedge-shaped space 16*b* are disposed a roller 31 for providing engagement between the cam surface 16*a* and the outer peripheral surface of the clutch inner member 27 and a spring 32 which presses the roller 31 in the direction in which said engagement is made. Thus, the overrunning clutch mechanism is constituted by the cam surfaces 16*a*, the clutch inner member 27, the rollers 31 and the springs 32, and the armature rotary shaft 16 itself also serves as a clutch outer member which carries out one function of the mechanism.

A pinion shaft 33 which defines an output rotary shaft is disposed in a passage formed inside the armature rotary shaft 16 and the tubular clutch inner member 27. The pinion shaft 33 is rotatably as well as axially slidably supported at one end thereof through a bearing 34 which is fitted to the inner peripheral portion of the clutch inner member 27. The other end of the pinion shaft 33 passes through a tubular member 37 rotatably supported through a bearing 36 which is fitted to a boss-shaped portion of a front bracket 35, and this end of the pinion shaft 33 projects outward from the front bracket 35. The projecting end of the pinion shaft 33 is provided with a pinion 33*a* which is engageable with a ring gear (not shown) of an engine. The pinion shaft 33 is in meshing engagement with the tubular member 37 through a helical spline 33*b* which is formed in the outer peripheral surface of the pinion shaft 33.

The extended portion of the clutch inner member 27 which is rotatably supported by the center bracket 29 through the bearing 30 terminates immediately in front of the tubular member 37. The terminating end portion is carried by a bearing 38 fitted on the pinion shaft 33, and a sun gear 39*a* which constitutes an epicyclic reduction gear 39 is generated on the peripheral surface of this end portion of the clutch inner member 27. An internal gear 39*b* which is formed by utilizing the center bracket 29 is disposed around the sun gear 39*a*, and a plurality of planet gears 39c are disposed in an annular space defined between the sun gear 39*a* and the internal gear 39*b*, the planet gears 39*c* being meshed with both the gears 39*a* and 39*b*. The planet gears 39*c* are mounted through respective pins 39*e* on a carrier 39*d* which is supported through the aforementioned bearing 38. The carrier 39*d* is formed integral with the tubular member 37. Therefore, when the carrier 39*d* is caused to rotate by the revolution of the planet gears 39*c*, the tubular member 37 rotates together with the carrier 39*d* in one unit.

A recess 40 is formed in the rear end face of the pinion shaft 33. A first holder 41 in the shape of a tube, one end of which is open, is loosely fitted in the recess 40. A steel ball 42 which is thrust-bearing is disposed between the closed end of the first holder 41 and the innermost wall of the recess 40.

The engine starter 10 according to this embodiment further includes an electromagnetic switch 43 (hereinafter referred to simply as "switch") which causes the pinion shaft 33 to slide and which also has a switching function whereby, when a key switch (not shown) of the vehicle is turned on, the switch 43 causes contacts to be closed so as to enable the d.c. motor 15 to be supplied with electric power from a battery. The switch 43 is connected to the outer end of the rear bracket portion 11*a* by means of a bolt 44. The switch 43 consists of an exciting coil 46 which is wound on a plastic bobbin supported by forward and rearward cores 45*a* 45*b* which form a magnetic path together with a casing 43*a*, a plunger 47 slidably disposed in the central opening formed in the bobbin, and a moving assembly 48 secured to the plunger 47. The plunger 47 is subjected to force from a coil spring 49 disposed between the same and the forward core 45*a* so that the plunger 47 returns to its original position shown in FIG. 1 when the key switch is turned off.

The moving assembly 48 has a rod 48*a* having one end thereof secured to the plunger 47 and the other end disposed so as to face the first holder 41 provided on the rear end of the pinion shaft 33. A third holder 48*c* is rigidly secured to the outer periphery of that end portion of the rod 48*a* which is closer to the plunger 47, the holder 48*c* having an opening 48*b* which opens toward the pinion shaft 33. A movable contact member is slidably fitted on the outer peripheral portion of the third holder 48*c*, the contact member having a movable contact 48*e* sandwiched between two insulators 48*d*. A second holder 50 is fitted on the other end portion of the rod 48*a* in such a manner that the holder 50 is axially slidable on the outer peripheral surface of the rod 48*a*. Between the second holder 50 and the inner end face of the opening 48*b* in the third holder 48*c* is disposed a spring 51 which presses the pinion shaft 33 forward, that is, rightward as viewed in FIG. 1. Between the second end face of the rod 48*a* and the inner end face of the first holder 41 is also disposed a spring 52 which presses the pinion shaft 33 forward. It should be noted that the reference numeral 43*b* denotes a non-magnetic plate which closes the rear end of the casing 43*a*. The plate 43*b* serves as a stopper for stopping the plunger 47 when it is returned rearward and also defines a rear wall of the electromagnetic switch 43.

The operation of the above-described engine starter 10 according to the embodiment will next be explained.

When the key switch (not shown) is off, the exciting coil 46 is in a de-energized state and therefore not excited, and the plunger 47 is subjected to the force from the spring 49 alone. Accordingly, the moving assembly 48 is located at its rearward position, and the plunger 47 is in contact with the plate 43*b*. In this state, the fixed contact 23 and the movable contact 48*e* are separate from each other and the d.c. motor 15 is therefore at rest. The pinion shaft 33 is also positioned at its rearward position by the action of the spring which is provided between the bearing 34 and the retaining ring disposed at the rear end of the shaft 33.

When the key switch is turned on, the exciting coil 46 is energized and the plunger 47 is thereby urged to move. In consequence, the moving assembly 48 moves forward, resulting in the movable contact 48*e* coming into contact with the fixed contact 23. Accordingly, the armature coils 19 are energized through the brushes 18 and the commutator 14, and the d.c. motor 15 is thus started.

The rotation of the armature rotary shaft 16 caused by the d.c motor 15 thus being started is transmitted to the clutch inner member 27 through the rollers 31, and the rotation of the clutch inner member 27 causes each of the planet gears 39*c* of the epicyclic reduction gear 39 to revolve about the sun gear 38*a*. In consequence, the carrier 39*d* rotates together with the tubular member 37 in one unit at a reduced speed. The rotation of the tubular member 37 causes the pinion shaft 33 to rotate through the engagement provided by the helical spline 33*b*.

On the other hand, the pinion shaft 33 is pressed forward by the springs 51, 52 of the moving assembly 48, thus causing the pinion 33*a* to mesh with the ring gear which is rigidly secured to the outer periphery of a flywheel of the engine at the same time as the start of the d.c. motor 15. After the starting of the engine, when the clutch inner member 27 is reversely urged by the ring gear through the pinion shaft 33, the tubular member 37 and the epicyclic reduction gear 39 so as to rotate at a higher speed than that of the armature rotary shaft 16, the engagement between the clutch inner member 27 and the armature rotary shaft 16 is canceled by the function of the one-way overrunning clutch, thus allowing the armature rotary shaft 16 to rotate under no load. Upon the completion of the starting of the engine, the key switch is turned off to cut off the power supply, so that the moving assembly 48, together with the plunger 47, is returned rearward by the action of the spring 49 provided inside the electromagnetic switch 43 and the pinion shaft 33 is also returned rearward by the action of the spring which is provided around its rear end.

As has been described above, it is possible according to the present invention to reduce by a large margin the overall length of a coaxial type engine starter equipped with an epicyclic reduction gear by incorporating the overrunning clutch inside the armature rotary shaft of the d.c. motor.

Although the present invention has been described through specific terms, it should be noted here that the described embodiment is not necessarily exclusive and that various changes and modifications may be imparted thereto without departing from the scope of the invention which is limited solely by the appended claim.

What is claimed is:

1. A starter for an engine comprising:

a motor means comprising an armature which includes a hollow armature rotary shaft and an armature core mounted on the outer periphery of said armature rotary shaft;

an overrunning clutch means comprising a clutch over member and a clutch inner member, for transmitting the rotative force of said motor means to said clutch inner member, said overrunning clutch means being coaxially disposed within said hollow armature rotary shaft;

said clutch outer member comprising said hollow armature rotary shaft;

said clutch inner member comprising a tubular member coaxially received and rotatably supported within said armature rotary shaft;

an output rotary shaft means coaxially disposed within said clutch inner member and supported slidably in the axial direction;

an epicylic reduction gear train means for transmitting the rotative force of said clutch inner member to said output rotary shaft means without preventing the axial sliding motion of said output rotary shaft;

means for sliding said output rotary shaft in the axial direction.

2. A starter as claimed in claim 1 in which said overrunning clutch further comprises:

cam surfaces formed on the inner peripheral surface of said armature rotary shaft;

wedge-shaped spaces defined between said cam surfaces and the outer peripheral surface of said clutch inner member;

and at least one roller disposed in each of said wedge-shaped spaces for transmitting the rotative force of said armature rotary shaft to said clutch inner member when said rollers provide engagement between said cam surface and said outer peripheral surface of said clutch inner member.

3. A starter as claimed in claim 2 in which said epicyclic reduction gear train further comprises:

a sun gear formed on said clutch inner member, an internal gear fixedly disposed around said sun gear, planet gears meshed with both said sun gear and sun internal gear, and a carrier rotatably disposed adjacent to said planet gears so as to support said planet gears rotatably.

4. A starter as claimed in claim 3 wherein said armature core is press-fitted on the outer peripheral portion of said armature rotary shaft.

5. A starter as claimed in claim 4 wherein said clutch inner member is rotatably supported through a bearing which is disposed at the end of said armature rotary shaft.

6. A starter as claimed in claim 5 wherein a spring is disposed in each of said wedge-shaped spaces so as to press said rollers in a direction in which said rollers provide engagement between said cam surface and said outer peripheral surface of said clutch inner member.

7. A starter as claimed in claim 6 wherein said sun gear is formed on the outer peripheral surface of said clutch inner member.

8. A starter as claimed in claim 7 wherein said internal gear is formed on a center bracket of a yoke of said motor means.

9. A starter as claimed in claim 8 wherein said motor means comprises a d.c. motor.

10. A starter according to claim 9 wherein said means for transmitting the rotative force of said carrier to said output rotary shaft is a tubular member which engages with said output rotary shaft through a spline formed in the outer peripheral surface of said output rotary shaft.

11. A starter as claimed in claim 10 wherein said tubular member is formed integral with said carrier.

12. A starter as claimed in claim 11 wherein said means for sliding said output rotary shaft in the axial direction is an electromagnetic switch which is coaxially disposed with and arranged to cause said output rotary shaft to slide at the same time as said d.c. motor is energized.

13. A starter as claimed in claim 12 wherein springs are disposed between said output rotary shaft and said electromagnetic switch.

14. A starter as claimed in claim 13 wherein a pinion is formed at the distal end of said output rotary shaft.

15. A starter for an engine comprising:

a motor having an armature which includes a hollow armature rotary shaft and an armature core mounted on the outer periphery of said armature rotary shaft;

an overrunning clutch coaxially disposed within said hollow armature rotary shaft, said overrunning clutch comprising:

a clutch outer member comprising said hollow armature rotary shaft, cam surface formed on the inner peripheral surface of said armature rotary shaft, a tubular clutch inner member coaxially received and rotatably supported inside said armature rotary shaft, wedge-shaped spaces defined between said cam surfaces and the outer peripheral surface of said clutch inner member, and at least one roller disposed in each of said wedge-shaped spaces for transmitting the rotative forces of said armature rotary shaft to said clutch inner member when said rollers provide engagement between said cam surface and said outer peripheral surface of said clutch inner member;

an output rotary shaft coaxially disposed inside said clutch inner member and supported slidably in the axial direction;

an epicyclic reduction train for transmitting the rotative force of said clutch inner member to said output rotary shaft, comprising a sun gear formed on said clutch inner member, an internal gear fixedly disposed around said sun gear, planet gears meshed with both said sun gear and said internal gear, and a carrier rotatably disposed adjacent to said planet gears so as to support said planet gears rotatably;

means for transmitting the rotative force of said carrier to said output rotary shaft without preventing the axial sliding motion of said output rotary shaft;

a pinion formed at the distal end of said output rotary shaft; and means for sliding said output rotary shaft in the axial direction;

whereby the overrunning clutch is mounted within the hollow armature rotary shaft that also serves as the clutch outer member of the overrunning clutch, and the clutch inner member of the overrunning clutch engages with the epicyclic reduction train through the sun gear formed on the clutch inner member.

16. A starter according to claim 15, wherein said armature core is press-fitted on the outer peripheral portion of said armature rotary shaft.

17. A starter according to claim 15, wherein said clutch inner member is rotatably supported through a bearing which is disposed at the end of said armature rotary shaft.

18. A starter according to claim 15, wherein a spring is disposed in each of said wedge-shaped spaces so as to press said rollers in a direction in which said rollers provide engagement between said cam surface and said outer peripheral surface of said clutch inner member.

19. A starter according to claim 15, wherein said sun gear is formed on the outer peripheral surface of said clutch inner member.

20. A starter according to claim 15, wherein said internal gear is formed on a center bracket of a yoke of said motor.

21. A starter according to claim 15, wherein said motor is a d.c. motor.

22. A starter according to claim 15, wherein said means for transmitting the rotative force of said carrier to said output rotary shaft is a tubular member which engages with said output rotary shaft through a spline formed in the outer peripheral surface of said output rotary shaft.

23. A starter according to claim 22, wherein said tubular member is formed integral with said carrier.

24. A starter according to claim 15, wherein said means for sliding said output rotary shaft in the axial direction is an electromagnetic switch which is arranged to cause said output rotary shaft to slide at the same time as said d.c. motor is energized.

25. A starter according to claim 24, wherein springs are disposed between said output rotary shaft and said electromagnetic switch.

* * * * *